US007032359B1

(12) United States Patent
Robert et al.

(10) Patent No.: US 7,032,359 B1
(45) Date of Patent: Apr. 25, 2006

(54) ROLL WRAP CRIMPER

(75) Inventors: William Robert, Candiac (CA); Michel Sigouin, Huberdeau (CA)

(73) Assignee: Advanced Dynamics Corporation Ltd., St. Bruno (CA)

( * ) Notice: Subject to any disclaimer, the term of this patent is extended or adjusted under 35 U.S.C. 154(b) by 0 days.

(21) Appl. No.: 10/997,995

(22) Filed: Nov. 29, 2004

(51) Int. Cl.
*B65B 7/00* (2006.01)

(52) U.S. Cl. ..... 53/372.9; 53/136.2

(58) Field of Classification Search ..... 53/136.2, 53/372.9

See application file for complete search history.

(56) References Cited

U.S. PATENT DOCUMENTS 3,063,214 A * 11/1962 Ellman, Jr. ..... 53/372.9
3,605,382 A * 9/1971 Andersson ..... 53/372.9
3,924,375 A 12/1975 Brenner et al.
4,326,001 A * 4/1982 Sachs et al. ..... 428/161
4,845,919 A 7/1989 Fujii et al.
5,174,095 A 12/1992 Fujiwara et al.
5,642,600 A 7/1997 Hooper et al.
5,907,941 A 6/1999 Fukuzumi et al.
6,381,921 B1 5/2002 Tale et al.
6,678,928 B1 1/2004 Wallace

* cited by examiner

*Primary Examiner*—John Sipos
(74) *Attorney, Agent, or Firm*—Dilip Andrade; Borden Ladner Gervais LLP

(57) ABSTRACT

A crimper and method for crimping roll wrap overhang are provided. The crimper comprises a rotatable support for mounting to a drive shaft, a folding member on the support for engaging and bending flexible material (such as paper roll wrap) to generate a fold upon rotation of the support about a support axis, and a crease roller on the support in direction of rotation behind the folding member for creasing the fold upon rotation of the support. The crimper and crimping method are particularly suitable for crimping roll wrap overhangs of over 6 inches. The present invention also provides a crimping assembly comprising the crimper described herein.

11 Claims, 4 Drawing Sheets

ROLL WRAP CRIMPER

FIELD OF THE INVENTION

The present invention relates generally to roll wrap crimpers. More particularly, the present invention relates to a crimper and method for crimping roll wrap overhang on paper rolls.

BACKGROUND OF THE INVENTION

For many decades, paper companies have wrapped their product rolls (such as paper rolls and other packages) in heavy kraft paper or other flexible and durable materials to protect them from damage in transit or storage. The process of wrapping the package generally consists of placing a covering of this material (called "roll wrap" which is derived from a "wrapper stock") around the circumference of the paper roll (also called a "bilge"), attaching an inner protective disc ("inner head") of heavy paper, chip board or corrugated medium against each paper roll end, crimping the excess roll wrap against the ends of the paper roll or inner head, and gluing/sealing an outer protective disc of heavy paper ("outer head") on to the crimped roll wrap and/or the inner head.

The roll wrap is typically selected from the available widths of wrapper stock in unwind stands ("backstands") used in the wrapping facility, and is usually substantially wider than the paper roll. The extra width, called the wrap overhang, is distributed more or less equally at each end of the paper roll, and ultimately forms the crimped portion of the package. In small manual wrapper systems, crimping is usually done by hand. In automated wrapping systems, individual paper rolls are typically transferred to wrapping platforms on which they are wrapped by roll wrap.

Wrapper stock is stored in the form of rolls of varying widths in the wrapping system. Each individual width is in its own backstand. In automated wrapping systems, the diameter and width of each incoming paper roll is measured by a control system. This system selects the best wrapper stock width from the available choices and calculates what length of wrapper must be provided to the given paper roll diameter to give the number of wrapper convolutions of wrapper required by the client. Depending on the needs of the client and the availability of particular widths of wrapper stock, the wrapper may or may not be optimal for the width of the roll.

In automatic wrapping systems, the wrapper stock is fed close to the paper roll, and glue is applied to the leading edge. The wrapper stock is advanced until it is pinched between the paper roll and a set of turning platform rollers on which the paper roll is resting. The platform rollers are actuated at the same speed as the wrapper stock supply speed and the wrapper stock is pinched between the paper roll and the turning rollers. The wrapper stock adheres to the paper roll and is carried around the paper roll until the correct number of convolutions has been applied. The system is stopped, the wrapper stock is severed and, simultaneously, a strip of glue is applied to the tail end of the roll wrap derived from the wrapper stock.

The platform rollers are restarted, drawing the tail end into a pinch point causing the tail of the roll wrap to adhere to the convolutions already applied. At this point, the roll wrap overhangs the paper roll ends forming a large "tube". The length of the overhang depends on the width of the wrapper stock used and the length of the paper roll to be wrapped. After inner heads are inserted and retained at the ends of the paper roll, the wrap overhang is crimped.

As is understood in the art, crimping of the wrap overhang typically involves folding down the ends of the roll wrap towards the end of the paper roll. Crimping can also include creasing the folded wrap overhang to maintain the folds on the end of the paper roll. This extra step helps to prevent the folded material from "springing" back up away from the end of the paper roll. Depending on the flexibility of the roll wrap material to be crimped and the number of layers in the wrap overhang, folding alone may not be sufficient to ensure an effectively crimped package.

The crimped wrap overhang serves two functions. It provides a surface against which the outside head is placed and sealed to complete a package. Additionally, after the package is complete, the crimped wrap overhang provides a protective buffer inside the package between the end of the paper roll and the floor when the paper roll is stored on its end. It is essential to create a "regular" or successfully crimped wrap overhang. The more regular the crimp, the more effective the crimped material acts as a cushion and protection for the end of the paper roll.

Current practice usually involves the use of crimping wheels which engage the wrap overhang while in rotation. A typical crimper wheel consists of a disc having a number (typically 4 to 6) of crimping paddles or blocks. The disc is usually mounted on the end of a drive shaft which rotates the crimper wheel. The drive shaft is supported by a pivot arm, which holds the drive shaft at one end to lift and lower the crimper wheel relative to the wrap overhang. When the crimper wheel is lowered into a crimping position, the paper roll is also caused to rotate. During this process, wrap overhang is "slapped" by the crimping blocks, pushing the wrap overhang towards the centre of the roll end. As the paper roll is rotated, new wrap overhang is continuously presented to the crimper. This continues until the entire wrap overhang has been crimped.

Crimpers of the above-mentioned type are well known in the prior art, and are typically incorporated into standard paper roll packaging assembly stations. U.S. Pat. No. 5,642,600, issued to Hooper et al., discloses an apparatus for wrapping, crimping and plating a wrapped roll at a single station. The crimper includes a plurality of crimper paddles that slide against the overhanging wrapper to fold it to the roll end when the crimper paddles are rotated as a unit about a horizontal axis. Similar crimpers of this sort in the package wrapping industry are shown in U.S. Pat. No. 6,678,928, issued to Wallace, and U.S. Pat. No. 6,381,921, issued to Tale' et al.

There exist certain problems with these "paddle-type" crimpers. Determining optimal crimping block/paddle geometry has traditionally been arbitrary, left in the hands of skilled professionals who have selected the shapes and number of blocks based on their own personal experience with the crimper. A scientific approach to crimper design is largely unknown and daunting, considering the number of dynamic variables to be considered, including the optimal width of the block, the rotational speed of the crimping wheel, and the thickness of the wrap overhang. Because of the apparent lack of crimper design standards, it has been difficult to efficiently achieve uniform and effective crimping of wrap overhang of different materials and sizes. Many of the crimpers currently in operation are ineffective in producing a stable, effective crimp. These crimpers merely fold the wrap overhang on the ends of the paper roll without creasing the folds that are generated. Consequently, there is an increased risk for damage to the paper rolls resulting from improper packaging.

Current technology has been most successful in producing crimps with 4" of wrap overhang. For wider wrap overhangs, the quality of the crimping diminishes. While typical crimps produced with 4–6" of wrap overhang are acceptable, poor results are achieved when the wrap overhang exceeds 6". With a wide range of paper roll widths to wrap, and the limited choice of wrapper stock widths in most packaging factories to meet the needs of discriminating clientele, it is inevitable that the lengths of certain wrap overhangs will be outside the optimum range for crimping. With poor crimping comes non-uniform crimp pitch, wrinkling and bunching of the roll wrap. Thus, there is a need to prevent undesirable results when crimping wrap overhang longer than about 6".

There also exist problems when current crimpers are used with heavier wrapping material, such as heavy kraft paper. The problems arise in situations of increased friction between the crimper blocks and the wrap overhang. It has been found that abrupt engagement of current crimpers and the wrap overhang contributes to an irregular crimp pitch, leading to wrinkling and unwanted creasing of the wrap overhang. This is undesirable, as an improperly crimped wrap overhang can allow the contents of the paper roll to be exposed to the elements, such as moisture and dirt. Also, an outer head cannot properly adhere to the end of the paper roll. This can result in damage to the paper roll when the paper roll is positioned on end (as is commonly done in paper roll storage facilities).

To reduce friction, freely-rotatable crease rollers have been used in the wrapping industry as well as many other related industries. Crease rollers of this type appear in several prior art crimper systems. U.S. Pat. No. 3,924,375, issued to Brenner et al., discloses a crimping device for crimping the projecting ends of dual-wrap paper wrapped around the circumference of a roll. The device comprises a displacement member for starting displacement of the projecting wrapper ends, a tucking member which operates after the displacement member to tuck the displaced ends toward the roll end, and a rolling member following the tucking member for rolling the tucks into flat successive crimps against the roll ends. The three members are mounted to a swinging arm which engages the members into a crimping position against the roll. The crimping action takes place along the circumference of the roll end. A problem with this arrangement is evident in, for example, FIG. 6 of Brenner et al. There is an increased risk for wrinkling and improper creasing of the wrap overhang, since the folds must align properly to ensure a smooth crimp.

U.S. Pat. No. 5,907,941, issued to Fukuzumi et al., describes a film roll wrapping apparatus comprising a folding unit for folding a protruding part of a photographic film roll. Folding blades abut against protruding parts and fold them down onto the end face of the photographic film roll. As the roll is rotated, the folded wrap is heat-sealed to the end of the roll by a heating roller, followed by a cooling roller. Both rollers are positioned along the circumference of the roll.

U.S. Pat. No. 4,845,919 discloses an apparatus for folding and pleating "ears" of packaging material wrapped around a cylindrical article. A bending guide is pressed against the side surface of a roll and a folding unit (comprising a pressing device, a folding roll and a folding claw) swings to press the ear of the packaging material. As the folding unit and the roll rotate relative to each other, a folding claw is engaged to fold in the pressed ears.

U.S. Pat. No. 5,174,095 discloses a device for packaging a rolled web comprising a feed roller which rolls in the direction of the rotating rolled web, a rotating folding member (truncated cone rotating opposite to the direction of the web roll), and a fold-keeping plate for holding the folded sections toward the web roll.

In the above-described crimpers, and other known devices having a crimp-roller mechanism, the crease rollers typically serve to crease (or press down to keep folded) wrap overhangs along the circumference of the roll end. This can be potentially disadvantageous, considering the rapid crimping required in high-throughput operations. Bunching of the wrap overhang can occur, particularly at the beginning and end of the crimping action. This results in less-than-optimal crimping and packaging of the paper roll, decreasing efficiency and adding unnecessary expense to the operation.

It is, therefore, desirable to provide a crimper and method of crimping that reduces the occurrence of poor quality crimps and is especially suitable for crimping wrap overhangs of more than 6 inches.

SUMMARY OF THE INVENTION

It is an object of the present invention to obviate or mitigate at least one disadvantage of previous roll wrap crimpers and crimping methods.

In a first aspect, the present invention provides a crimper for crimping flexible material comprising a rotatable support for mounting to a drive shaft, for rotation about a support axis, a folding member on the support for engaging and bending the flexible material to generate a fold upon rotation of the support and a crease roller on the support in direction of rotation behind the folding member for creasing the fold upon rotation of the support, the crease roller having a roller axis extending perpendicular to the support axis.

In one embodiment of the present invention, the support comprises at least one arm disposed perpendicularly to support axis. A preferred embodiment is a support having four arms in the shape of a cruciform with a folding member and crease roller mounted to each arm.

Using a freely turning crease roller on the crimper considerably reduces friction between the roll wrap and the crimper, substantially eliminating wrinkles and tears in the wrap overhang.

In addition, it has surprisingly been found that the folding member and creasing roller tandem of the present invention is ideally suited for folding down longer wrap overhangs, particularly those over 6 inches in length. This feature allows the crimper of the present invention to successfully fold wrap overhangs which are too wide for current crimpers.

In another aspect of the present invention there is provided a method of crimping wrap overhang on a paper roll having a paper roll axis and an end face, comprising the steps of forcing a portion of the wrap overhang towards the paper roll axis for generating a fold in the wrap overhang and creasing the fold against the end face with a creasing member moving in a tangential arc over the end face.

Surprisingly, it has been found that the unified sweeping motion provided by the successive tandem combination of a folding member and a creasing member (such as a crease roller) on a single rotating support which forces the wrap overhang inward toward the centre of the roll end, is effective in generating more regular crimps. By folding and creasing the wrap overhang in a tangential arc over the roll end, rather than "pushing" it along the circumference of the roll, the wrap overhang is more effectively folded and creased.

In another aspect of the present invention there is provided a crimper assembly comprising a platform for receiving an item to be crimped, a pivotable arm mounted on the platform, a motorized drive shaft mounted on an end of the pivotable arm, and the crimper as described herein.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only and with reference to the attached Figures, wherein.

DETAILED DESCRIPTION

Generally, the present invention provides a crimper and method of crimping roll wrap overhang. In one aspect, the present invention provides a crimper for crimping flexible material comprising a rotatable support for mounting to a drive shaft, for rotation about a support axis, a folding member on the support for engaging and bending the flexible material to generate a fold upon rotation of the support and a crease roller on the support in direction of rotation behind the folding member for creasing the fold upon rotation of the support, the crease roller having a roller axis extending perpendicular to the support axis.

Preferably, the crimper is used in the packaging of web rolls, such as paper rolls and the like. Typically, the crimper of the present invention is used with current paper roll packaging systems. Alternatively, the crimper can form part of a stand-alone integrated paper roll packaging system. The crimper is especially suited to crimping wrap overhang of protective and flexible roll wrap (such as kraft paper) at the ends of the rolls, thus readying the package for the placement of an outside head, if necessary, and eventual storage and transportation of the roll.

Figure 1:
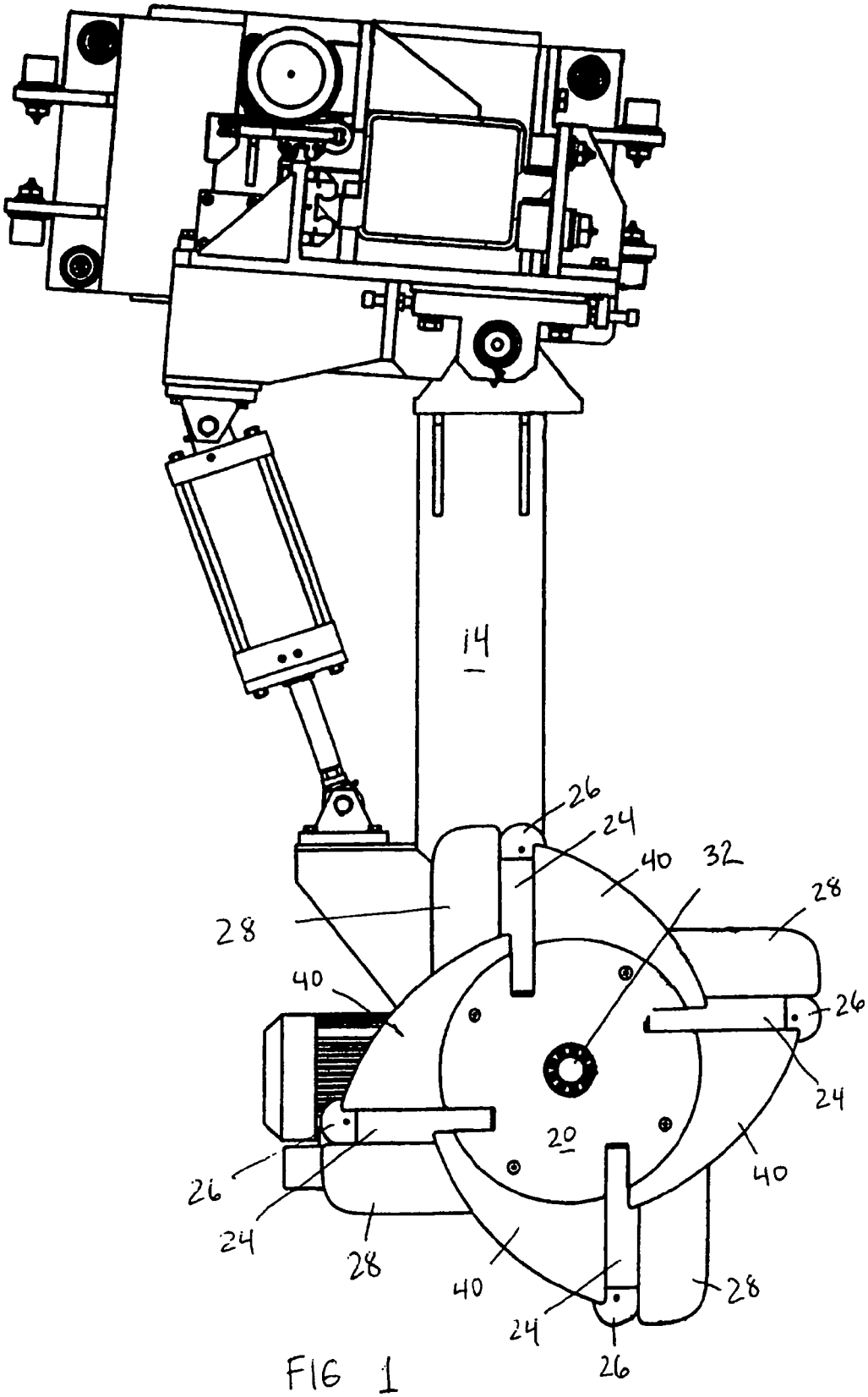
FIG. 1 shows a front view of the crimper of the present invention mounted to a standard pivot arm used in packaging assemblies.

The crimper of the present invention comprises a rotatable support, a folding member and a crease roller. Embodiments of the rotatable support include crimping "wheels", as shown in the Figures. FIG. 1 illustrates one embodiment of a crimper of the present invention mounted to a typical drive shaft and pivot arm. The drive shafts used with the present invention are known in the art and extend from pivoting lift-and-lower arms which place the crimper in proximity with an end of the paper roll and wrap overhang thereon. A main drive shaft extending outward from pivot arm 14 is attached to a crimper at a central location 32 of the rotatable support. The crimper is rotatable about the longitudinal axis of the drive shaft. which forms the support axis.

The rotatable support is typically a member of any shape or length including, for example, a block, rod, or ring, and made of a durable material such as steel, for supporting the folding member and the crease roller. The rotatable support can be mounted on the main drive shaft of standard crimping apparatuses. In the embodiments shown particularly in FIGS. 3 and 4, the rotatable support has one or more arms 30 which extend perpendicularly from a central location 32 on the rotatable support. In this embodiment, the rotatable support is substantially cruciform in shape and has four equally spaced arms 30*a*, 30*b*, 30*c* and 30*d*, of approximately the same length.

A folding member 28, as shown mounted on the rotatable support illustrated in the Figures, is preferably made of any rigid material, such as metal, and is sturdy enough to fold the wrap overhang of any typical roll wrap material, such as kraft paper and the like. Additionally, the folding member 28 should be able to effectively fold down one or more layers of wrap overhang. The embodiment described herein has been used successfully to fold at least 10 layers of kraft paper wrap overhang. The folding member 28 is typically mounted on each arm 30 of the rotatable support. The folding member 28 can be any width or thickness, and is interchangeable with other folding members as needed for a particular crimping task. The folding member 28 can either be slidable or fixedly positioned according to the needs of the user. In certain embodiments of the crimper of the present invention, the folding member 28 can be adjustable radially from a central location 32 on the rotatable support and/or along an arm 30. A crimper using the folding member 28 described substantially herein is particularly suitable for wrap overhangs greater than 4 inches in length and, unlike crimpers known and used in the art, can be used for crimping wrap overhangs of 6 inches or greater.

Figure 2:
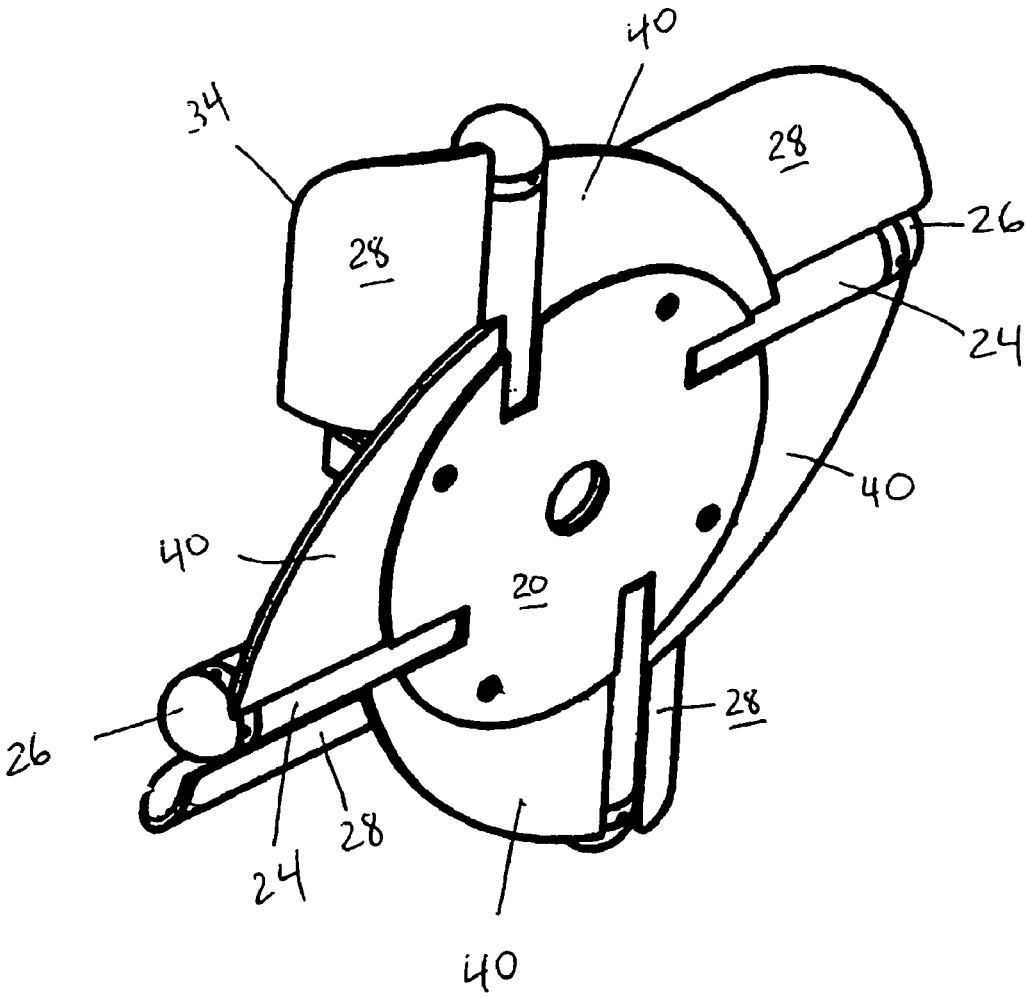
FIG. 2 shows an isolated front perspective view of the crimper of the present invention.
Figure 3:
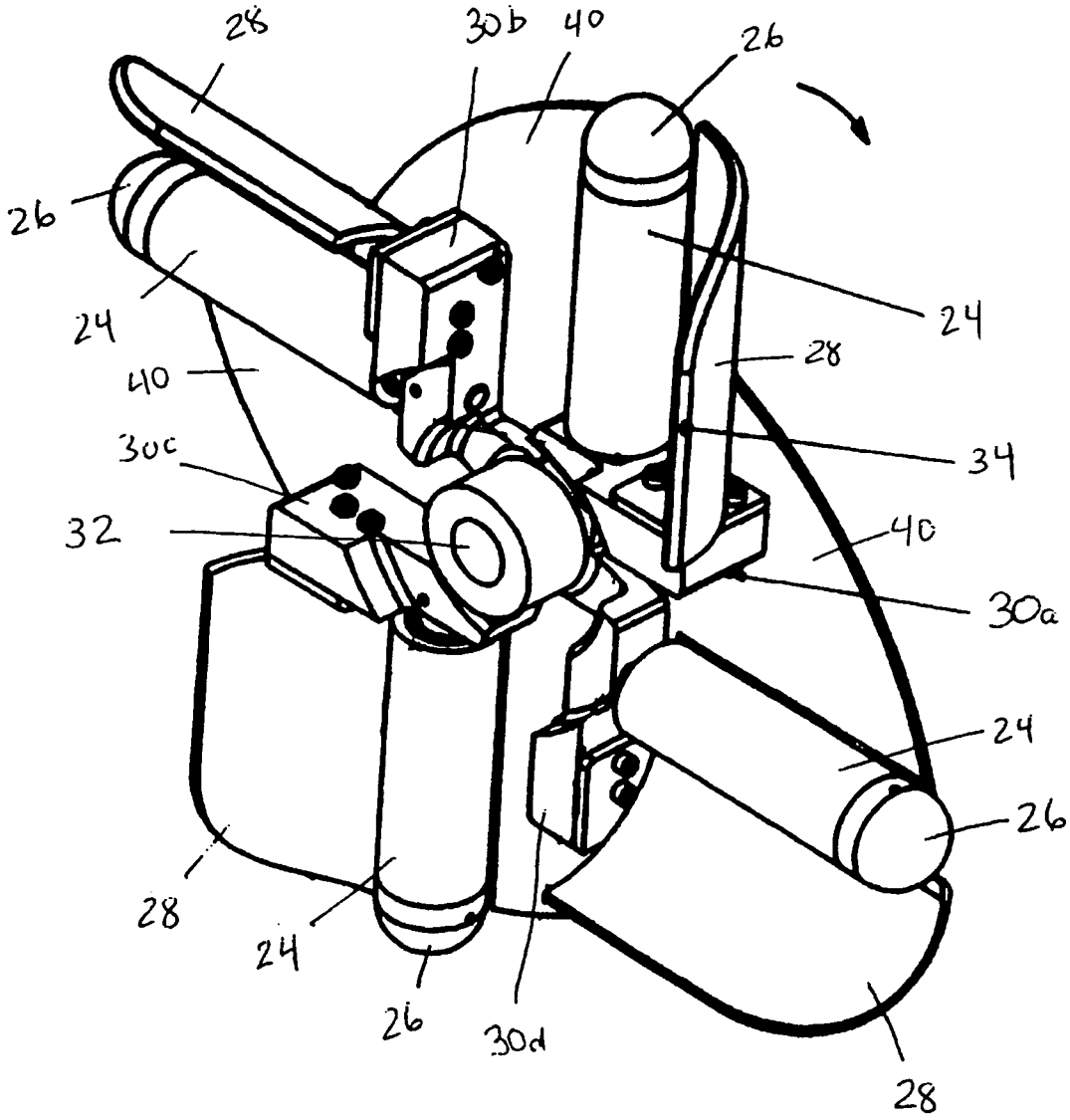
FIG. 3 shows an isolated rear view of the crimper of the present invention.
Figure 4:
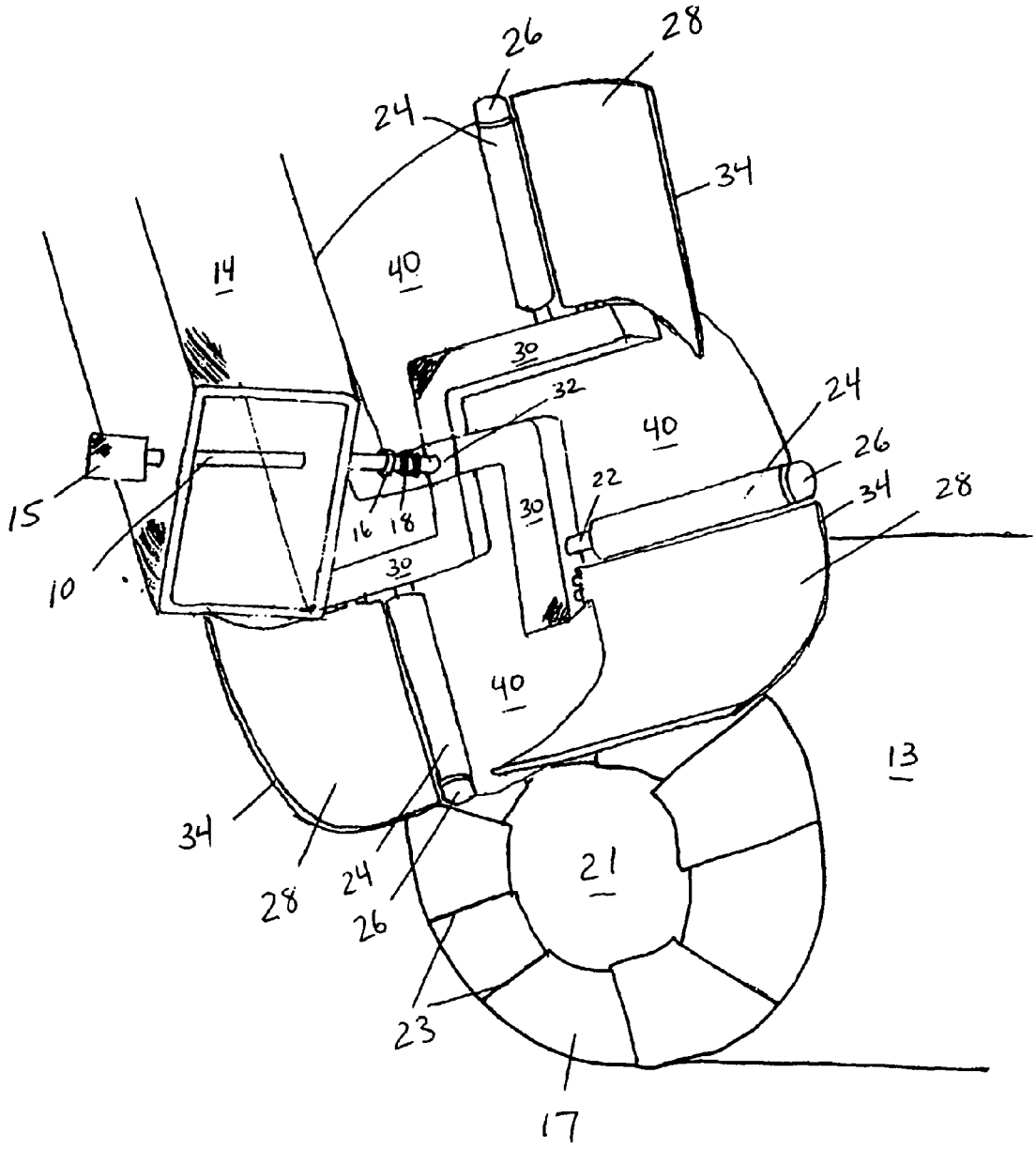
FIG. 4 shows a crimper of the present invention in the operation of crimping roll wrap overhang.

As shown in FIGS. 2, 3 and 4, folding members used in the present invention are curved inward, away from the leading edge of an arm 30 (i.e., the edge facing the wrap overhang 17 to be crimped at an end of the paper roll). In this way, wrap overhang 17 is less likely to be damaged by a free end 34 of the folding member 28, since this free end 34 typically points away from, and does not touch, the wrap overhang 17 when the crimper is rotated about the drive shaft 10. However, a substantially planar member could also be used as a folding member, though the crimping results are likely to be less than optimal.

Mounted in tandem on the rotatable support in the direction of rotation behind the folding member is a crease roller. In the embodiment shown particularly in FIGS. 3 and 4, a roller shaft 22 machined to an arm 30 accepts a crease roller 24 which freely rotates about the roller shaft 22. Each crease roller 24 is mounted on ball bearings (not shown) on the roller shaft 22. The crease roller 24 serves to crease the folds made by the folding member 28. A cap 26 is placed at the end of the crease roller 24 to provide a smooth end on the crease roller, thus protecting the wrap overhang from damage when the crease roller 24 strikes the wrap overhang. In FIG. 3, the arrow shows the direction of rotation of the crimper.

The crease roller 24 is mounted on the arm 30 such that its rolling face extends outward from the arm 30 and/or the folding member 28. This ensures that the crease roller 24 performs the creasing with minimum friction between the wrap overhang 17 and the rotatable support. Optimally, the rolling face of the crease roller 24 should extend beyond the arm 30 and/or the folding member 28 by a distance of approximately 0.16 inches (approximately 4.064 mm), but this distance can be varied by the user depending on the material to be crimped.

Optionally, a face plate can be added to the crimper of the present invention. In the embodiment shown in FIGS. 1 and 2, a face plate 20 is affixed to the rotatable support, typically on an edge of the arms 30 facing the wrap overhang to be crimped. The face plate 20 can be any metal disc or other sturdy disc. The face plate 20 provides a durable flat surface for ensuring optimal crimping of the wrap overhang 17. It can also be used as a means for correcting any misalignment between the crimper and an end of the paper roll when the pivot arm 14 is lowered into the crimping position (see FIG. 4). When a face plate is used, a rolling face of the crease roller 24 should extend outward from the face plate by at least the same distance described above.

Optionally, and as shown in FIG. 2 in particular, the crimper of the present invention has a filler plate 40 mounted on to the rotatable support, either to an arm 30 or a face plate 20, depending on the embodiment used. The filler plate 40 serves to maintain the crease generated by the creasing roller, preventing the wrap overhang 17 from "springing out" before the wrap overhang 17 comes into contact with the next folding member 28 and crease roller 24 tandem, thus reducing instances of improper crimping. The filler plate 40 can be any shape, but is typically scimitar or arcuate in shape in keeping with the rotational motion of the crimper. The filler plate 40 should permit sufficient clearance between successive folding members 28 for accessing wrap overhang 17 which is presented to the crimper for crimping, when more than one folding member 28 is used.

Optionally, a spring is used with the crimper described herein. As shown in FIG. 4, the spring 18 mounts on the end of a standard main drive shaft interposed between a collar of the drive shaft 10 onto which a retention nut 16 is secured, and the crimper at the second end of the drive shaft. The spring 18 provides two functions. First, it allows for misalignment between the crimper and the end 21 of the paper roll 13 when the pivot arm 14 bearing the crimper is lowered into the crimping position. Second, it stabilizes the crimper to provide a uniform axial load from the crimper to the end 21 of the paper roll 13 regardless of any variations in the flexible material to be crimped. It provides constant pressure between the crimper and the flexible material.

In another aspect of the present invention there is provided a method of crimping wrap overhang on a paper roll having a paper roll axis and an end face, comprising the steps of forcing a portion of the wrap overhang towards the paper roll axis for generating a fold in the wrap overhang and creasing the fold against the end face with a creasing member moving in a tangential arc over the end face. In this method, a unified sweeping motion is provided by the tandem combination of a folding member (which forces a portion of the wrap overhang towards the paper roll axis and generates a fold in the wrap overhang) and creasing member (such as the creasing roller described above) on a single rotating support. The folding and creasing of the wrap overhang in a tangential arc over the roll end generates more regular crimps on the end of the paper roll than is typically achieved with standard crimpers. Consequently, folding and creasing of the wrap overhang is achieved more effectively than other systems which "push" the wrap overhang along the circumference of the roll.

FIG. 4 illustrates the crimper of the present invention in operation. After roll wrap has been applied to the paper roll 13, a control system effectuates a pivot arm 14 by lowering it into a crimping position, wherein the crimper is adjacent to the wrap overhang 17 at the end of the paper roll 13. Platform rollers (not shown), on to which the wrapped paper roll rests, are activated and the wrapped paper roll 13 starts to turn at a selected rotational rate. The crimper, mounted on drive shaft 10 powered by a drive gear box 15, is also caused to rotate, turning at a pre-selected rate.

The pivot arm 14 is then lowered and the crimper begins to engage the wrap overhang 17. The folding member 28 meets the wrap overhang 17 first and begins the crimping action by deflecting and folding the wrap overhang 17 downwards towards a central region 21 on the end of the paper roll 13. The crease roller 24 then engages the wrap overhang 17 and completes the crimping action by rolling over and creasing the folds 23 created by the folding member 28. The crimping process continues until the entire wrap overhang 17 has been crimped. At this time, the rotation of the crimper is stopped and the pivot arm 14 raises the crimper from its crimping position. An outside head (not shown) is affixed onto the crimped end of the paper roll to complete the packaging of the paper roll 13 and to prepare it for transportation and/or storage.

The tandem action of the folding member 28 and the crease roller 24 in one crimper has been shown to be more effective in crimping wrap overhang. Unlike current crimper wheels having a series of paddles which merely "slap" the wrap overhang, the crimper of the present invention combines two distinct features of crimping, namely folding and creasing. The crease roller 24 creases the wrap overhang 17 folded by the folding member 28, resulting in a complete crimp.

Additionally, and unlike current crimpers which use a folding mechanism and a roller along the circumference of the end of the roll ("fold-roller" crimpers), the crimper of the present invention provides a method of crimping wrap overhang in one sweeping rotating motion. Through the rotational movement of the crimper, the folding member 28 folds the wrap overhang 17 on the end face of the paper roll towards the paper roll axis while the crease roller 24 follows in the same direction of rotation, creasing the folds made by the folding member 28. This action reduces the risk of "bunching" the wrap overhang 17 typically found with circumferential fold-roller crimpers, and generates more effective crimps.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A crimper for crimping flexible material about an item having a longitudinal axis comprising:

a rotatable support for mounting to a drive shaft, for rotation about a support axis of said shaft other than said longitudinal;

a folding member on the support for engaging and bending the flexible material to generate a fold upon rotation of the support; and a crease roller on the support in direction of rotation behind the folding member for creasing the fold upon rotation of the support, the crease roller rotating about a roller axis extending perpendicular to the support axis.

2. The crimper of claim 1 further comprising a face plate on the rotatable support for correcting misalignment between the crimper and the flexible material.

3. The crimper of claim 1 further comprising a filler plate for maintaining the crease generated by the crease roller.

4. The crimper of claim 3, wherein the filler plate is arcuate or scimitar shaped.

5. The crimper of claim 1 further comprising a spring assembly helically surrounding the drive shaft between a collar on the drive shaft and the support, for aligning and stabilizing the support.

6. The crimper of claim 1 wherein the support comprises an arm disposed perpendicularly to the support axis.

7. The crimper of claim 6 wherein the folding member is mounted on the arm.

8. The crimper of claim 6 wherein the crease roller is mounted on the arm.

9. The crimper of claim 8 wherein the crease roller rotates on about a roller shaft mounted on the arm.

10. The crimper of claim 1 wherein the flexible material is paper.

11. A crimper assembly comprising:

a platform for receiving an item to be crimped having a longitudinal axis, a pivotable arm mounted on the platform, a motorized drive shaft mounted on an end of the pivotable arm, and a crimper having a rotatable support for mounting to a drive shaft, for rotation about a support axis of said shaft other than said longitudinal axis; a folding member on the support for engaging and bending the flexible material to generate a fold upon rotation of the support; and a crease roller on the support in direction of rotation behind the folding member for creasing the fold upon rotation of the support, the crease roller rotating about a roller axis extending perpendicular to the support axis.

* * * * *

UNITED STATES PATENT AND TRADEMARK OFFICE

CERTIFICATE OF CORRECTION

PATENT NO. : 7,032,359 B1
APPLICATION NO. : 10/997995
DATED : April 25, 2006
INVENTOR(S) : William Robert et al.

It is certified that error appears in the above-identified patent and that said Letters Patent is hereby corrected as shown below:

Column 8, line 52 (claim 1), insert the word - -axis- - after the word “longitudinal”; and Column 10, line 7 (claim 11), delete “a” after the word “to” and insert therefor - -said- -.

Signed and Sealed this

Twenty-ninth Day of August, 2006

JON W. DUDAS
*Director of the United States Patent and Trademark Office*